United States Patent [19]

Bernle

[11] Patent Number: 4,493,687

[45] Date of Patent: Jan. 15, 1985

[54] ARRANGEMENT FOR THE RAISING AND TRANSPORTING OF PACKING CONTAINER BLANKS

[75] Inventor: Göte L. Bernle, Malmö , Sweden

[73] Assignee: Tetra Pak International AB, Lund, Sweden

[21] Appl. No.: 354,023

[22] Filed: Mar. 2, 1982

[30] Foreign Application Priority Data

Mar. 13, 1981 [SE] Sweden ..... 8101604

[51] Int. Cl.[3] ..... B31B 1/76

[52] U.S. Cl. ..... 493/310; 493/316

[58] Field of Search ..... 493/316, 317, 310, 313

[56] References Cited

U.S. PATENT DOCUMENTS 3,534,667 10/1970 Krause ..... 493/316 X
3,613,525 10/1971 Lense et al. ..... 493/315
3,739,696 6/1973 Pearson ..... 493/316 X
4,029,001 6/1977 Reichert ..... 493/310
4,066,009 1/1978 Calvert et al. ..... 493/316
4,285,682 8/1981 Moss ..... 493/316

*Primary Examiner*—James F. Coan
*Attorney, Agent, or Firm*—Burns, Doane, Swecker & Mathis

[57] ABSTRACT

An arrangement for the raising and transporting of packing container blanks is used in a packaging machine of the type which converts tubular packing container blanks to filled and sealed packing containers. The arrangement has a carrier plate which by a plurality of suction heads grips a flattened packing container blank situated in a magazine and transports the same to a conveyor (4). During the transport the packing container blank is converted with the help of stationary supports, situated in the path of movement of the blank, so that it obtains a substantially square cross-section.

19 Claims, 12 Drawing Figures

ARRANGEMENT FOR THE RAISING AND TRANSPORTING OF PACKING CONTAINER BLANKS

BACKGROUND AND SUMMARY OF THE INVENTION

The present invention relates generally to material handling equipment. More specifically the present invention relates to an arrangement for the raising and transporting of packing container blanks from a first to a second position by a movable carrier device.

Within the branch of the packaging industry which is concerned with the packing of certain types of liquid goods, e.g. milk, into consumer packages of the non-returnable type, packing machines are used which convert prefabricated packing container blanks into packing containers, which subsequently are filled directly with the desired contents and sealed. The packing container blanks are fed to the machine in the form of flattened tubular blanks which, prior to conversion to individual packing containers, have to be "raised", that is to say converted to four-sided tubes of substantially square cross-section. This conversion or raising usually takes place at the same time as the transfer of the blank from a magazine at the inlet end of the packing machine to a first processing station in the packing machine proper.

A known arrangement for the raising and transporting of a packing container blank at the inlet end of a packing machine is described in U.S. Pat. No. 3,785,113. The arrangement comprises a substantially vertical magazine for flattened packing container blanks and a conveyor situated in the vicinity of the lower end of the magazine for the transport of the raised packing container blanks one at a time to a mandrel wheel in the packing machine proper. At the lower end of the magazine there is a movable carrier device, provided with pneumatic suction heads, which is rotatable substantially ¼ turn between a first position directly next to the lower end or outlet of the magazine and a second position close to the starting end of the conveyor. The arrangement also includes a support, situated outside the arc-shaped path of movement of the carrier device, intended to co-operate with and to raise a packing container blank which is transported by the carrier device from the outlet end of the magazine to the conveyor. Since the carrier device grips a flattened container blank situated in the magazine from underneath and during the raising and transport, so to speak, drags it along, the blank, after it has been placed in raised condition onto the conveyor, has to be carried off by the same before the carrier device can perform its return stroke. Otherwise, the raised blank situated on the conveyor would hinder the return stroke. This is a disadvantage which brings with it a reduction of the overall operating speed of the arrangement. The operating speed is also limited by the speed at which the raised packing container blank is transported by the conveyor.

A further known arrangement for the raising and transporting of packing container blanks on packaging machines is described in U.S. Pat. No. 3,937,131. This arrangement too is designed so that from a magazine with a number of flattened packing container blanks, one blank at a time is transferred, with simultaneous raising, to a feeding station in a packaging machine. In this construction it was attempted to overcome the abovementioned speed-reducing disadvantage by making the carrier device move, not in a reciprocating movement, but on a rotary path along which is arranged an external support in such a manner that it acts upon and raises the passing packing container blanks. By this the need for a return stroke is eliminated, and the arrangement, therefore, can operate at a relatively high speed. However, the arrangement becomes relatively complicated, since it has to include a number of different carrier and guide elements. The method allowing the carrier device to perform the work, that is to say, the transporting and raising of the packing container blank during the greater part of one whole rotation, also means that the arrangement will be extremely space-demanding and therefore unsuitable for use in modern, compact packaging machines.

It is a main object of the present invention to provide an arrangement for the raising and transporting of packing container blanks, which arrangement is not subject to the disadvantages of similar arrangements described above, but can operate at high speed without being hindered by raised packing container blanks fed previously.

It is a further object of the present invention to provide an arrangement of the abovementioned type, which is compact in its construction and operates within a limited range of movement.

It is a still further object of the present invention to provide an arrangement which is less complicated than similar arrangements known previously and therefore more reliable in operation and less expensive.

These and other objects have been achieved in accordance with the invention in that an arrangement for the raising and transporting of packing container blanks from a first to a second position by a movable carrier or transport device includes a support or unfolding structure adapted to co-operate with the passing packing container blanks. The unfolding structure is arranged within the range of movement of the carrier device.

A preferred embodiment of the arrangement in accordance with the invention, which is intended first and foremost for the raising and transporting of flattened tubular packing container blanks from a magazine to a conveyor by a carrier device, has been given the further characteristic that the carrier device includes a carrier plate which, while retaining its positional orientation, is adapted so as to be moved along a substantially arc-shaped path of movement between a first position at the outlet end of the magazine and a second position at the starting end of the conveyor. The support, which is adapted to co-operate with and to raise the passing packing container blanks, is situated between the path of movement and the swivelling axis for the movement.

The general arrangement in accordance with the invention described above and particularly the preferred embodiment of the arrangement in accordance with the invention also described above, thus includes a carrier element adapted so as to transfer one packing container blank at a time from the magazine to the conveyor. The carrier device swivels to and fro between the magazine and the conveyor, and thus moves within a limited range, so that the space requirement of the arrangement is small. A further factor contributing to a high degree to the compact design of the arrangement is that the support, adapted to co-operate with and to raise the passing packing container blanks, is placed within the range of movement of the carrier device. Thus the packing container blanks, transported by the carrier device during the transport from the magazine to the conveyor, are with all parts within the range of movement of the carrier device. This appreciably reduces the need for free space around the working arrangement in accordance with the invention.

The fact that the carrier plate retains its positional orientation during its arc-shaped movement between the first and the second position makes it possible, moreover, to return the carrier device after transporting and raising of a packing container blank directly to the first position at the outlet end of the magazine. Therefore, no raised packing container blank, located on the conveyor, hinders the return movement of the carrier device, since the raised packing container blank is inside the path of movement of the carrier plate. By reason of this the effective working speed of the arrangement can be increased and the need for any waiting periods is eliminated.

Further preferred embodiments of the arrangement in accordance with the invention have been given, moreover, the characteristics recited below.

BRIEF DESCRIPTION OF THE DRAWINGS

A preferred embodiment of the arrangement in accordance with the invention will now be described in detail with special reference to the enclosed schematic drawings which only show the parts required for the understanding of the invention.

DETAILED DESCRIPTION OF THE PREFERRED EMBODIMENT

Figure 1:
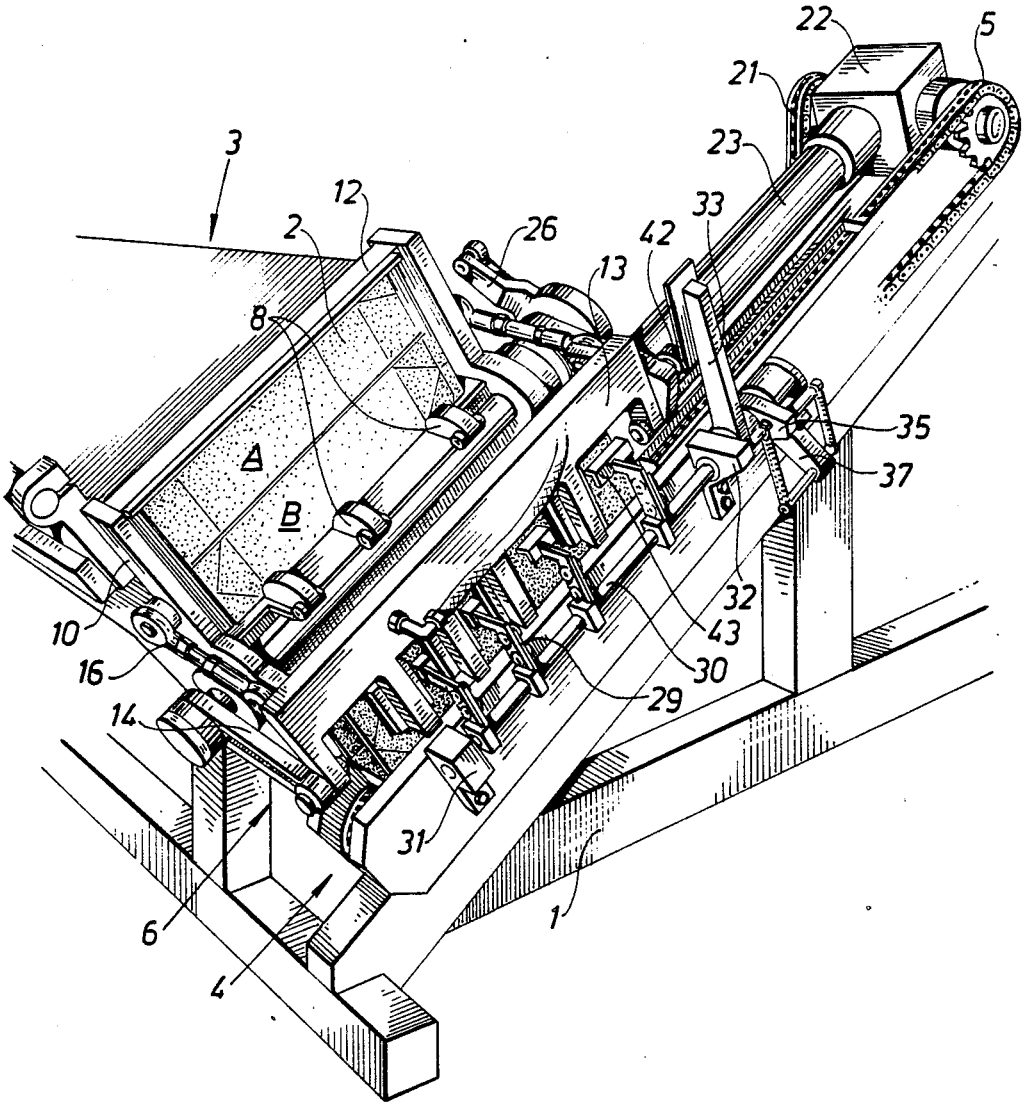
FIG. 1 is a perspective view over the arrangement in accordance with the invention, as the same is arranged in a packing machine (not shown) of known type.

FIG. 1 reveals how the arrangement in accordance with the invention includes a stand 1, which is joined to and, advantageously, may be supported by a packing machine of the known type (not shown), which converts packing container blanks to packing containers and fills and seals the same. The arrangement in accordance with the invention is intended to raise and transport packing container blanks 2 from a magazine 3 to a conveyor 4. The conveyor carries the blanks, raised by the arrangement in accordance with the invention, further on to the packing and filling machine proper, where the blanks are applied, for example, to a mandrel (not shown) directed towards the conveyor 4. As can be seen from FIG. 1, the conveyor 4 includes a conveyor chain 5, which extends at an angle to the horizontal plane (approx. 30°). To facilitate the transfer of the packing container blanks 2 from the magazine 3 to the conveyor 4, the magazine 3 too is arranged at an angle corresponding to the angle of the conveyor 4, which moreover serves to facilitate the manual feeding of packing container blanks 2 into the magazine 3.

The transfer of packing container blanks 2 from the magazine 3 to the conveyor 4 takes place by a carrier or transport device 6 which is adapted so that it can swivel to and fro between a first position at the outlet end of the magazine 3 and a second position at the starting end of the conveyor 4. During the transfer from the magazine to the conveyor 4 a folding over and raising of the individual packing container blanks 2 (FIG. 6) takes place at the same time. Thus, the packing container blanks engage with supports 8 which are arranged within the range of movement of the carrier device 6.

Figure 2:
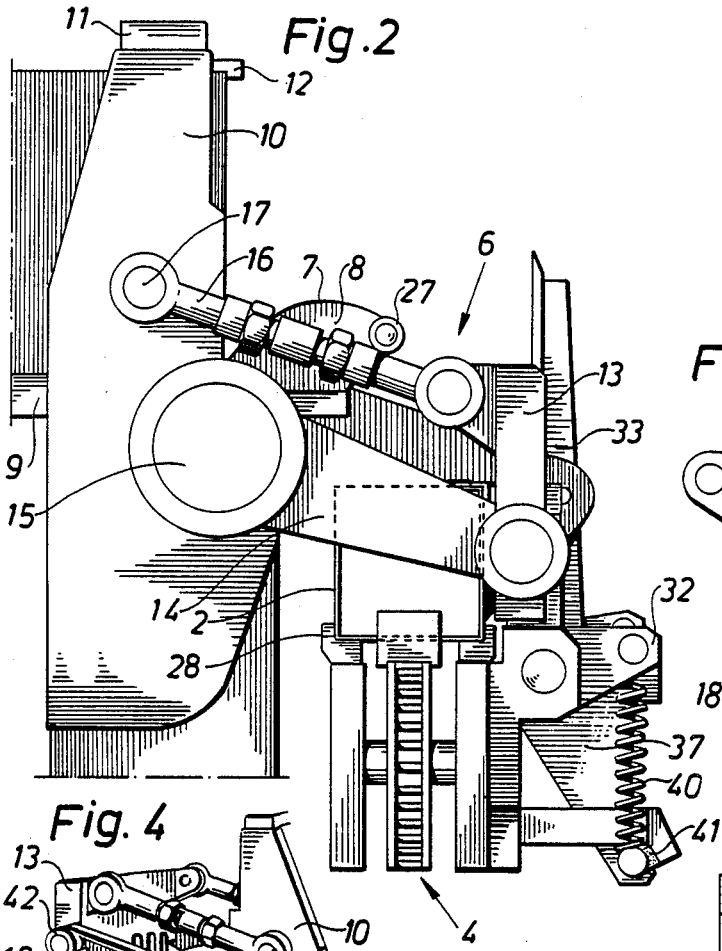
FIG. 2 is an end elevational view of the arrangement in accordance with the invention.

The magazine 3 (FIGS. 1, 2) includes a plane base plate 9 whose width substantially corresponds to the length of the packing container blanks 2 placed transversely in relation to the base plate. At one short side of the packing container blanks 2 a guide bar is provided to guide the packing container blanks and retain them in correct position on the inclined base plate 9. At the outlet end of the magazine 3 a magazine frame 10 is provided, which includes two fixed end plates and a rail 11 extending between them. The rail is arranged at a distance from the upper surface of the base plate 9 which is a little greater than the corresponding height of the plane packing container blanks 2 present in the magazine. On the rail 11 a stop 12 is provided, which engages with the top edge of the packing container blank 2 placed foremost in the magazine, and retains the packing container blank in correct position at the outlet end of the magazine. The series of the packing container blanks 2 present in the magazine 3 are pressed continuously against the stop 12 with a certain, predetermined force, so as to ensure that one packing container blank 2 is always present at the outlet end of the magazine, ready to be transferred to the conveyor 4. The device, adapted to urge the packing container blanks in the direction towards the outlet end of the magazine, is not shown in the figures, but may be constituted of any conventional arrangement, e.g. a spring- or weight-loaded pressure plate at the feeding end of the magazine.

Beside forming the outlet end of the magazine 3 the two end plates of the magazine frame 10 also provide a support for the carrier device 6 allowing it to swivel. The carrier device includes a carrier plate 13, which is suspended so that it can swivel about a (primary) swivelling axis 15 in the magazine frame 10 for movement along a substantially arc-shaped path of movement between a first position at the outlet end of the magazine 3 and a second position at the starting end of the conveyor 4. The carrier plate 13, more particularly, is prallelogram-suspended by two secondary arms 16 which, like the primary arms 14, are mutually parallel and are supported so that they can swivel about a secondary swivelling axis 17 in the magazine frame 10, as well as in the carrier plate 13. As a result the carrier plate 13 will substantially retain its positional orientation during its arc-shaped movement between the magazine and the conveyor, since the mutual distance between the respective swivelling axes of the two arms 14, 16 is the same. The swivelling axis 15 is located in the magazine frame 10 at some distance below the outlet end of the magazine 3 and right-angled to the longitudinal direction of the magazine. The carrier plate 13 is of a width which substantially corresponds to the width of the magazine, that is to say the length of the packing container blanks present in the magazine, and since the primary arms 14 as well as the secondary arms 16 are joined to the two short sides of the carrier plate, the free distance between the arms 14, 16 will exceed the length of the packing container blanks 2, so that these can freely pass between the arms 14, 16 as is cleary evident from FIG. 1.

The conveyor 4 is arranged right-angled to the magazine 3 and at the outlet end of the same. The distance between the conveyor 4 and the magazine 3 is such that a packing container blank situated on the active upper part of the conveyor will be situated between the swivelling axis 15 for the primary arms 14 and the arc-shaped path of movement of the carrier plate 13. By placing the conveyor right next to the magazine and at the same level as, or slightly lower than, the said swivelling axis 15, the transfer of packing container blanks from the magazine 3 to the upper active part of the conveyor can take place by a relatively limited swivelling movement of the carrier device between the first end position at the outlet end of the magazine 3 and the second end position above the starting end of the conveyor. In the preferred embodiment of the arrangement shown in the drawings, the carrier device operates within a swivelling range which amounts substantially to ⅓rd turn, that is to say the angle between the two end positions of the primary arms 14 amounts to approx. 120°.

Figure 3:
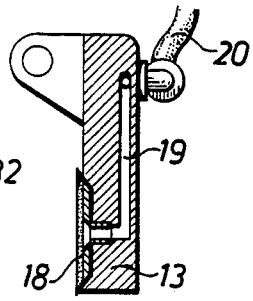
FIG. 3 is a sectional view through a detail of the arrangement shown in FIG. 2.

The carrier plate 13, as mentioned earlier, has a length which is slightly greater than the length of the packing container blanks 2 and includes a working surface equipped with pneumatic attachment devices 18 facing towards the magazine 3. The pneumatic attachment devices 18 are arranged at equal distances along the length of the carrier plate 13 and are constituted of suction heads which are made of a flexible material and which are connected via ducts 19 in the carrier plate (FIG. 3) and a flexible tube 20 extending from the carrier plate to a conventional source of vacuum (not shown) which can be connected at will to the pneumatic attachment devices 18.

Figure 4:
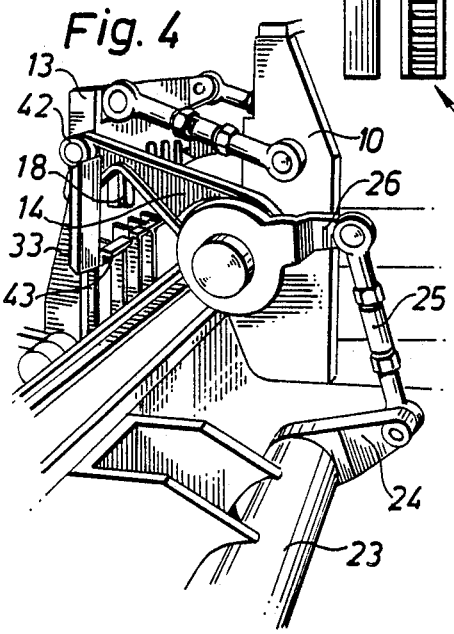
FIG. 4 is a rear perspective view of a part of the driving layout in the arrangement according to FIG. 1.

The reciprocating swivelling movement of the carrier device 6, as well as the continuous movement of the conveyor chain 5 are produced by a driving assembly, the function of which is evident in particular from FIGS. 1 and 4. The driving assembly includes a driving chain 21, continuously driven by a motor (not shown) which, via a transfer case 22, continuously drives the conveyor chain 5 as well as a driving axle 23 extending between the transfer case 22 and the carrier device 6. The driving axle 23 is provided at its end remote from the transfer case 22 with a projecting arm 24, which is connected by a driving link 25 to an arm 26 projecting from one primary arm 14 of the carrier device 6. On rotation of the driving axle 23 the arm 24 produces for each rotary turn a reciprocating movement of the driving link 25, which because the driving arm 24 is shorter than the arm 26, imparts a reciprocating movement to the carrier device 6. This common drive of the carrier device 6 and the conveyor 4 makes possible an invariably synchronous driving of these parts. It is possible for the driving chain 21, instead of being driven via a separate motor, to be driven by the motor of the packing machine with which the arrangement in accordance with the invention is intended to co-operate. This will ensure also an invariable synchronism between the arrangement in accordance with the invention and the packing machine proper.

Figure 6:
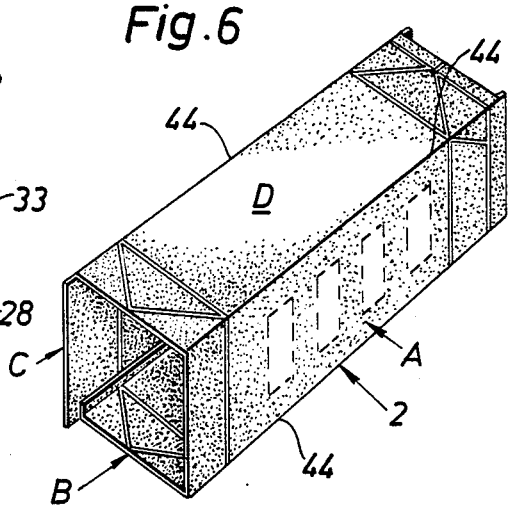
FIG. 6 is a perspective view of a packing container blank of the type which the arrangement in accordance with the invention is intended to raise and transport.

As mentioned earlier, during the transport of the packing container blanks from the magazine to the conveyor a so-called raising of the packing container blanks is taking place. That is to say the shape of the packing container blanks is altered from the flattened form, which the packing container blanks possess while they are in the magazine, to the raised shape of substantially square cross-section, which is illustrated in FIG. 6. To make possible this conversion of the packing container blanks during the transport from the magazine to the conveyor, supports or unfolding structures 8 are provided at the outlet end of the magazine. The supports are in the shape of projections with substantially arc-shaped working surfaces 7, which are situated at, and extend a little outside, the outlet end of the magazine in the extension of the base plate 9. A number of supports intended to act upon a packing container blank are arranged along the whole length of the same, in line with each other, along the terminal edge of the base plate 9, and placed so that they are between the path of movement of the carrier plate 13 and the swivelling axis 15 for the said movement. Thus the working surface 7 of the supports will be in contact with, and act upon, the packing container blanks 2, which are transported by the carrier plate 13 from the outlet end of the magazine 3 to the conveyor 4. To ensure a correct folding over and raising of each packing container blank which passes, each support extends sufficiently outside the base plate 9 of the magazine for its outer end to be situated largely above the starting end of the conveyor 4. To reduce friction against the packing container blank, the outer end of each support is provided with freely rotating pulleys 27, which are arranged in line with one another and form the outermost end of the support.

Figure 5:
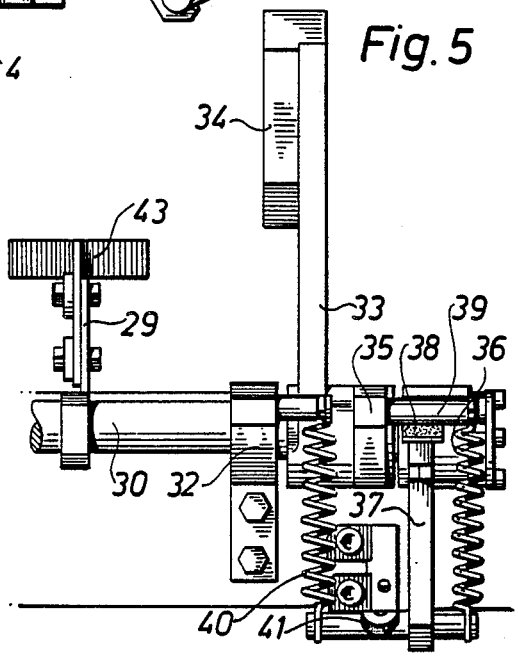
FIG. 5 is a side elevational view of a portion of the arrangement according to FIG. 1.
Figure 7A:
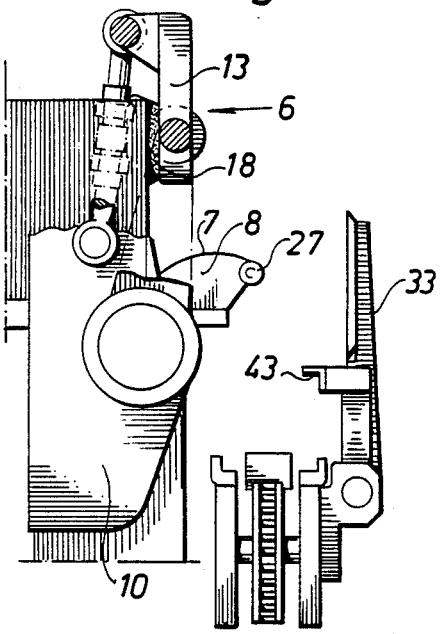
FIGS. 7*a–f* are simplified end elevational views corresponding to FIG. 2, which illustrate how the arrangement in accordance with the invention raises and transports a packing container blank according to FIG. 6.
Figure 7B:
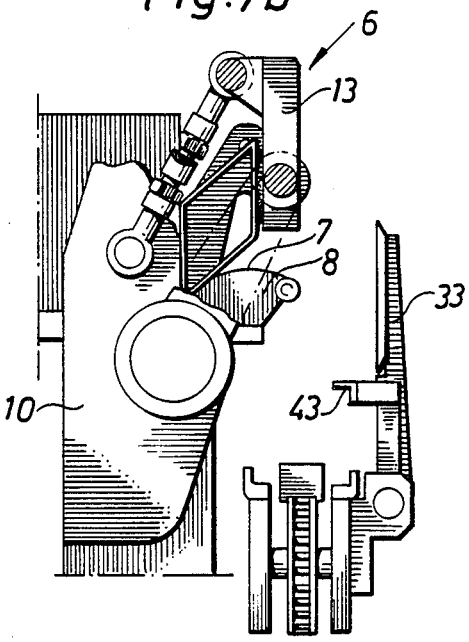

To retain the raised packing container blank in correct, raised position on the conveyor during the transport of the same from the starting end of the conveyor to the packing machine, a number of guide bars 28 are present along the active part of the conveyor. During the return movement of the carrier device 6 in the direction towards the outlet end of the magazine 3, the packing container blank placed onto the conveyor 4 is retained, moreover, by guide shoulders 43 which are arranged along the conveyor at a distance from each other and placed so in relation to the carrier plate 13 that they engage between the suction heads 18 of the carrier plate, as can be seen from FIG. 1. The guide shoulders 43 are arranged in line with one another and serve in principle as a further guide for the steering of the packing container blank. The shoulders 43 are carried by arms 29, which are firmly connected to an axle 30, which extends parallel with the conveyor and is supported so that it can freely rotate in brackets 31, 32 supported by the machine stand 1. One end of the axle 30 extends outside the bracket 32 and carries a maneuvering arm 33, supported so that it can rotate in relation to the axle 30, and the free end of which projects largely vertically upwards to the same level as the supports 8, where the maneuvering arm 33 is provided with a maneuvering plate 34 projecting sideways (FIG. 5). The maneuvering arm 33 is provided on its part supported on the axle 30 with a horizontally projecting lever arm 35, which via a spring 36 is connected to a corresponding lever arm 37 extending downwards from the axle 30. The spring 36 is a tension spring which endeavors to bring the two lever arms 35, 37 closer to one another, but this is counteracted by a shoulder 38 which, under the effect of the spring 36, rests against a projection 39 on the lever arm 35. A further tension spring 40 connects the lever arm 37 to the bracket 32 and thereby urges the axle 30 to rotate, so that the guide shoulders 43 are moved to their active position. At the active position, the rotary movement of the axle 30 is stopped owing to the lever arm 37 resting against a shoulder 41, firmly attached to the stand. The coupling together of the maneuvering arm 33 and the axle 30 via the spring 36 enables the axle 30, owing to the contact between the projection 39 of the lever arm 35 and the shoulder 38 on the lever arm 37, to follow along when the maneuvering arm 33, upon extension of the spring 40, is swivelled clock-wise, as shown in FIG. 7*d*. In contrast, a swivelling of the maneuvering arm in anticlockwise direction, past the vertical position, as shown in FIG. 7*a*, only causes the maneuvering arm 33, upon extension of the spring 36, to turn about the axle 30 without carrying it along. This is so since the rotary movement of the axle 30 is stopped by the stationary shoulder 41, when the guide shoulders 43 have reached their active position.

The packing container blank 2 shown in FIG. 6 is of a known type and consists of a sheet of material which through folding and sealing has been given the shape of a four-sided tube with four side surfaces A–D. Packing container blanks of this type are supplied in flattened form to the packing machines, that is to say the side walls (A,D; B,C) rest in pairs against each other so that the packing container blank is more or less planar and well suited to form, together with other packing container blanks, a compact stack. Such stacks, after the removal of any outer wrapping, are placed manually into the magazine 3 and pushed in direction of the outlet end of the magazine, so that the first packing container blank will rest with its top edge against the stop 12 of the magazine frame. With the help of conventional devices (not shown) a pressure is exerted automatically upon the stack on the side remote from the stop 12, so that the stack of packing container blanks is continuously shifted to remain in contact with the stop 12, as packing container blanks are transported to the conveyor 4 by the arrangement in accordance with the invention. To ensure an even feeding of packing container blanks in the direction of the outlet end of the magazine 3, the stop 12 may be made pressure-sensitive, or the magazine frame may be provided with some other device suitable for monitoring the pressure in the magazine, and so control the advance of the packing container blanks.

When the packing container blank 2 situated outermost at the outlet end of the magazine 3 is to be transported to the conveyor 4, the arrangement in accordance with the invention is driven with the help of the transfer case 22. A reciprocating movement is imparted to the carrier device 6 at the same time as the upper, active portion of the conveyor chain 5 is given a continuous movement from the starting end of the conveyor in front of the magazine 3 and in the direction towards the transfer case 22 and the packing machine, not shown on the drawing. At this the carrier device 6 is moved in an active working stroke from a first turning position, wherein the suction heads 18 of the carrier plate 13 rest against the flattened packing container blank situated at the outlet end of the magazine 3, and a second position, wherein the suction heads of the carrier plate 13 are directly above the guide bar 28 of the conveyor 4 situated at a distance from the magazine 3. The function of the arrangement will now be described in more detail with special reference to FIGS. 7*a*–7*f* which step by step shown the working stroke of the carrier device 6 during the transport and simultaneous raising of a packing container blank.

In FIG. 7*a* the carrier device 6 is in its upper turning position with the suction heads 18 of the carrier plate 13 resting against the upper, free wall panel of the packing container blank which is situated farthest forward at the outlet end of the magazine. This upper wall panel is indicated by reference letter A in FIG. 1, while a wall panel situated below panel A is indicated by reference letter B (see also FIG. 6). While the suction heads 18 of the carrier plate 13 are pressed against the top wall panel A, a connection is established via the ducts 19 and the tube 20 between the suction heads 18 and the source of vacuum mentioned earlier. Thus the carrier plate and the packing container blank situated in the outlet end of the magazine are positively joined to one another. The areas of application of the suction heads on the wall panel A of the packing container blank are indicated by dash-dotted lines in FIG. 6. As soon as the carrier plate 13 and the wall panel of the packing container blank have been joined to one another, the carrier device 6 commences its movement in the direction towards its second turning position. The packing container blank now follows the carrier plate 13 (FIG. 7*b*) and is converted at the same time successively from the substantially plane position, in which the packing container blanks are stored in the magazine 3, to a raised condition with a shape of substantially square cross-section, which the packing container blanks should have when they are introduced into the packing machine. This conversion takes place because the side face B of the packing container blank adjoining the side face A and situated nearer to the swivelling axle 15 (FIG. 1) will come into contact with, and slide over, the projecting working surfaces 7 of the supports 8, situated at the outer end of the base plate 9. These working surfaces 7 successively "approach" the arc-shaped path of movement of the suction heads 18, seen in the direction of movement of the carrier plate 13. To ensure that the raised packing container blank retains its substantially square cross-sectional shape, the raising of the blank must include a so-called prizing open of the folding lines (44, FIG. 6) situated between the different wall panels. This means that the packing container blank has to be folded to an appreciably higher degree along the folding lines than would be necessary for obtaining the square cross-sectional shape in order to ensure that the flexibility of the material does not cause the packing container blank to re-assume a more or less planar form after detachment from the arrangement in accordance with the invention.

Figure 7C:
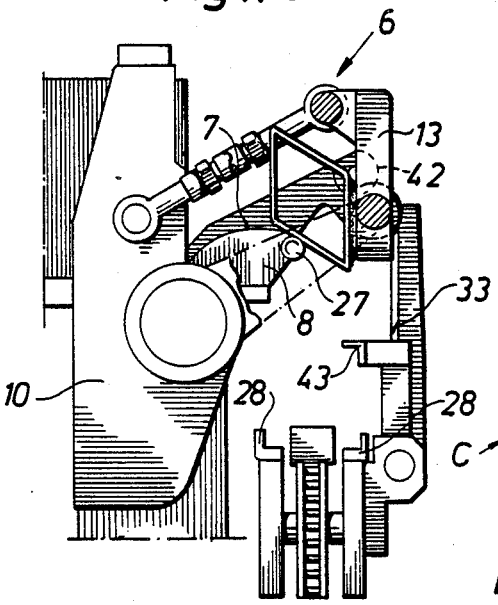
Figure 7D:
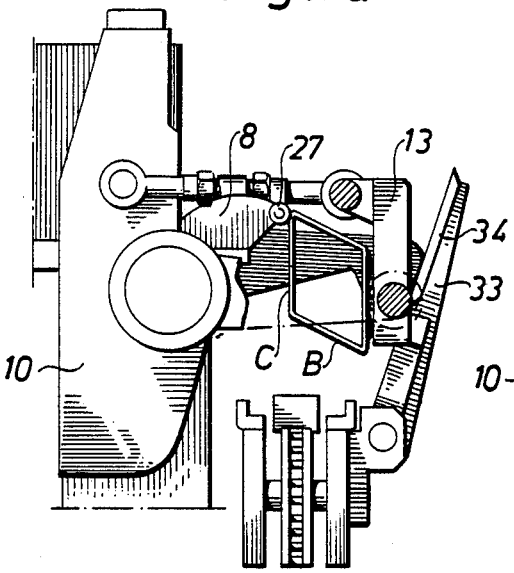

This prizing open of the folding lines is illustrated in FIG. 7*c*, where the carrier device 6 has performed about half its swivelling movement between the two end positions. In this position the suction heads are substantially in line with the outer ends of the supports 8 equipped with pulleys 27, that is to say. Thus the free distance between the suction heads and pulleys 27 is a minimum. As can be seen from the figure, the packing container blank has been folded well past its ultimately desired square position, and now presents a rhombic cross-sectional shape. The wall panel B of the packing container blank earlier has slid over the curved working surfaces 7 of the supports 8, and now passes over the pulleys 27, which further enforce the rhombic shape of the packing container blank, before they have completed their passage over the wall panel B. The guide shoulders 43, intended, together with the guide bars 28, to steer the raised packing container blank during its movement along the active portion of the conveyor, are continuing in their active position, but the maneuvering pulleys 42 at the outer end of the rear primary arms successively approach the maneuvering plate 34 in order to swivel the guide shoulders 43 out, in order to allow the packing container blank to be lowered down into its intended position on the conveyor 4.

In FIG. 7*d* the wall panel B, as well as almost the whole of the succeeding wall panel C, have passed the pulleys 27, at the same time as the maneuvering pulley 42 of the carrier plate 13 has rolled along the maneuvering plate 34. In this way, the manoeuvring arm has swivelled clockwise in the figure, and has caused the guide shoulders 43 to swivel out into an inactive position, wherein the packing container blank can pass the shoulders on its way in the direction towards the conveyor 4. The swivelling out of the guide shoulders 43 takes place, as mentioned already, by the maneuvering arm 33 being swivelled clockwise. As a result the lever arm 35, rigidly connected to the maneuvering arm 33, and the projection 39 act upon the shoulder 38 (not illustrated in FIG. 7, see FIG. 5), and this, via the axle 30 and the arms 29 swivels out the shoulders 43. The swivelling out occurs against the effect of the spring 40 which, via the lever arm 37, endeavors to retain the guide shoulders 43 in active position (see also FIG. 1).

Figure 7E:
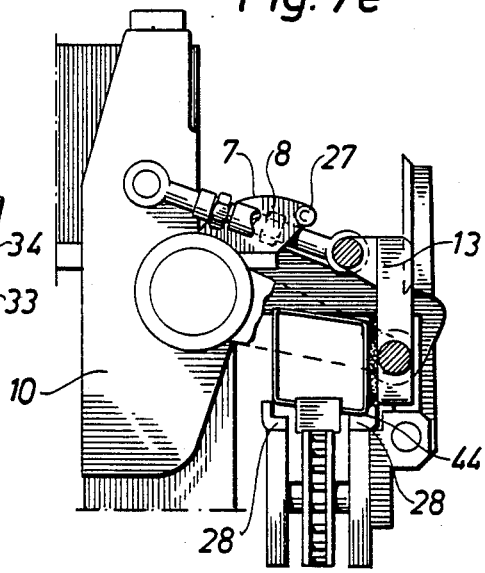

In FIG. 7*e* the carrier device 6 has attained its lower end position, the suction heads 18 of the carrier plate 13 being situated directly above the guide bars 28 of the conveyor. The packing container blank now has wholly passed the support 8 as well as the pulleys 27. At the moment shown on the drawing, the folding line 44 of the packing container blank between the side panels A and B has reached one of the two guide bars 28 at the same time as the packing container blank, owing to its inherent flexibility, is converted from the enforced rhombic cross-sectional shape to a substantially square cross-sectional shape. In this shape the packing container blank rests against the right hand as well as against the left hand guide bar 28. The maneuvering pulley 42 has just passed the maneuvering plate 34 which, owing to the effect of the spring 40, together with the guide shoulders 43, has been swivelled to its active position. In this position the guide shoulders rest against the folding line between the wall panels A and D, as can be seen clearly from FIG. 7*f*.

Figure 7F:
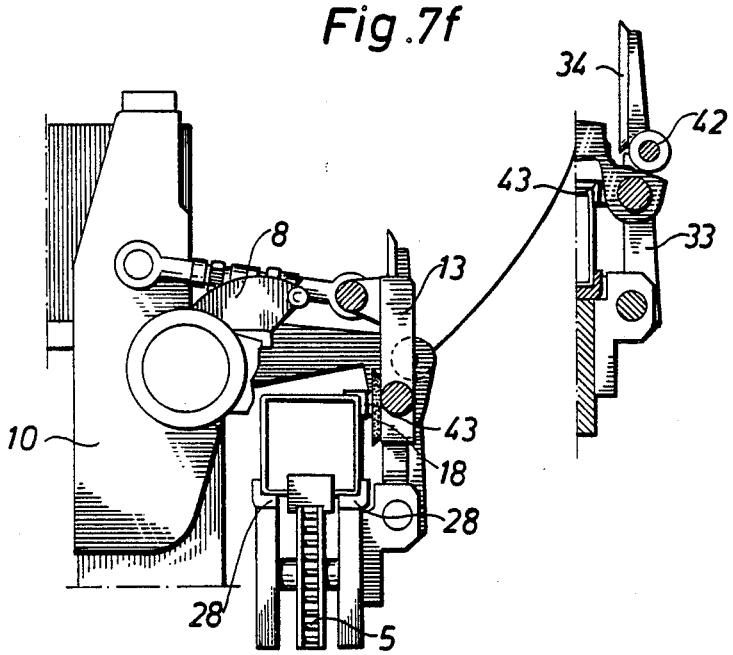

In FIG. 7*f* the connection of the suction heads 18 to the source of vacuum has been severed and the carrier plate 13 has been detached from the transferred packing container blank, whereupon the carrier device 6 has started its return movement in the direction of the magazine 3. The packing container blank is retained by the guide bars 28 and guide shoulders 43 on the conveyor and is transported by the carriers of the conveyor chain 5 in raised condition in direction of the packing machine. During the return movement of the carrier device 6 the guide shoulders 43 should be in their active position so as to steer the packing container blank which is transported along the conveyor. This means that the guide pulley 42 has to pass the maneuvering plate 34 without acting upon the guide shoulders. This is done by allowing the maneuvering pulley to pass along the back of the maneuvering plate 34, that is to say the side remote from the magazine 3. Owing to the arc-shaped movement of the guide pulley in direction of the magazine the maneuvering plate 34 is forced to follow over a certain distance in direction of the magazine, until the maneuvering pulley 42 has passed the top end of the maneuvering plate. At this the maneuvering arm 33 is swivelled anticlockwise, so that the projection 39, against the effect of the spring 36 (FIG. 5), leaves the shoulder 38 without acting upon the lever arm 37 which is mechanically connected to the guide shoulders 43. After the maneuvering pulley has passed the whole maneuvering plate 34 (FIG. 4), the spring 36 returns the maneuvering arm to a vertical position. When the carrier device 6 once more has attained its upper end position a new identical operating cycle commences to transfer the next packing container blank to the conveyor, which in the meantime has transported the packing container blank transferred earlier in the direction of the packing machine.

After a raised packing container blank has been placed in correct position between the guide bars 28 and the guide shoulders 43, the packing container blank remains in this position until one of the carriers of the conveyor chain 5 comes into contact with the blank and commences to transport the same in the direction of the packing machine. The presence of a packing container blank on the part of the conveyor chain situated in front of the magazine 3 does not, thanks to the design of the arrangement, hinder the return stroke of the carrier device 6 in the direction of the magazine, since the carrier plate 13 is moved substantially vertically upwards during the first part of the return stroke, as can be seen from FIG. 7*f*. This is a great advantage compared with earlier arrangements, in which the carrier plate or its equivalent is moved during the return stroke to the magazine in such a manner past the conveyor that the return stroke cannot properly take place before the packing container blank situated on the conveyor has been moved out of the path of movement of the carrier plate. This considerably limits the capacity of the arrangement.

A further advantage of the arrangement in accordance with the invention, compared with earlier arrangements, is the very limited space requirement. This is due primarily to the carrier plate gripping the packing container blank in such a manner that during the whole of its transport from the magazine to the conveyor it moves within the arc-shaped range of movement of the carrier plate. This also makes it possible to place the support 8 wholly within the range which is limited by the arc-shaped path of movement of the carrier plate and the swivelling axis of the carrier plate. This compact construction is particularly valuable in modern packing machines which are designed with a view to the greatest possible production within the least possible space. The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. An arrangement for transporting and simultaneously unfolding container blanks, comprising:

a magazine for holding a plurality of flattened container blanks;

conveyor means for conveying away the container blanks after they have been unfolded;

a carrier device for transporting the flattened container blanks one at a time from the magazine to the conveyor means, the carrier device being relatively reciprocated along a substantially arc-shaped path of movement between a first position at an outlet end of the magazine and a second position above the conveyor; and, an unfolding structure for unfolding the container blanks while they are being transported by the carrier device, including a carrier plate and a parallelogram-type support for the carrier plate, the carrier plate being of a width substantially corresponding to a width of the magazine, the support including two parallel first arms both of which pivot about a first swivelling axis and two parallel second arms both of which pivot about a second swivelling axis, the second axis being parallel to the first axis, wherein the carrier plate is maintained in a substantially vertical orientation throughout the substantially arc-shaped path of movement of the carrier device and wherein a return movement of the carrier plate is unhindered by the unfolded packing containers due to the unfolded packing containers positioned interiorly of the width of the carrier plate within the arc-shaped path of movement of the carrier plate.

2. The arrangement of claim 1 wherein the carrier device is selectively reciprocated between the first and second locations and includes a carrier plate which moves along a substantially arc-shaped path of movement between the outlet end of the magazine and the conveyor, the carrier plate retaining a substantially vertical orientation throughout its arc-shaped path of movement and wherein the carrier plate swivels around a first swivelling axis to maintain its substantially vertical orientation through its path of movement.

3. The arrangement of claim 2 wherein the carrier plate is supported by two parallel primary arms which at the opposite ends are suspended so as to move about the first swivelling axis and wherein the first swivelling axis is positioned at a right angle to the magazine.

4. The arrangement of claim 2 wherein the conveyor is arranged at the outlet end of the magazine and wherein a conveyor chain of the conveyor is located between the first swivelling axis and the path of movement for the carrier plate.

5. The arrangement of claim 1 wherein the unfolding structure includes a plurality of ribs, each rib having a substantially arc-shaped working surface with a freely rotating pulley being positioned at one end of each rib.

6. The arrangement of claim 3 wherein the carrier plate is also supported by two secondary arms which, like the primary arms, are supported in a manner allowing the two secondary arms to swivel in the carrier plate and about a second swivelling axis whereby the carrier plate has a parallelogram-like suspension.

7. The arrangement of claim 2 wherein the first swivelling axis is located below the outlet end of the magazine, the primary arms extending on both sides of the magazine and wherein the conveyor is located substantially adjoining the magazine at approximately the same level as the first swivelling axis.

8. The arrangement of claim 1 further comprising power means for synchronously powering both a reciprocating motion by the carrier device and a continuous forward motion by the conveyor means.

9. The arrangement of claim 2 wherein the swivelling movement of the transport means between the first location at the outlet end of the magazine and the second location above the conveyor amounts is approximately ⅓rd turn.

10. The arrangement of claim 1 wherein the unfolding structure extends into a path of movement of a packing container blank being transported by the transport means.

11. The arrangement of claim 1 wherein the unfolding structure are rib-shaped and extend outside the outlet end of the magazine and wherein the unfolding means extend above the starting end of the conveyor.

12. The arrangement of claim 8 wherein the power means includes a driving axle which has disposed at its first end a transfer case for continuously driving a conveyor chain of the conveyor means, the driving axle having disposed at its second end arm means for producing a reciprocation of the carrier device for each rotation of the driving axle.

13. The arrangement of claim 2 wherein the arrangement further includes a plurality of guide shoulders located along the conveyor, the guide shoulders being movable between an active position in which they contact a packing container blank situated on the conveyor and a passive position.

14. The arrangement of claim 13, wherein the guide shoulders are urged by a spring into the active position.

15. The arrangement of claim 14, wherein the guide shoulders are mechanically coupled to a maneuvering arm co-operating with the carrier plate so as to urge the guide shoulders into the passive position when the carrier plate is moved from the magazine to the conveyor.

16. The arrangement of claim 2 or 1 wherein the carrier plate includes at least one pneumatic attachment device for retaining the packing container blanks the attachment device being provided on the side of the carrier plate facing towards the magazine.

17. The arrangement of claim 12 wherein the conveyor means further includes a guide bar positioned on either side of the conveyor chain and at least one guide shoulder, the guide bars and the at least one guide shoulder retaining the container blank in unfolded form and steering the container blank along the path of the conveyor chain.

18. A method for transporting and simultaneously unfolding packing container blanks, comprising:

gripping an upper panel of a flat container blank, held in a substantially vertical orientation at a first location by transport means;

moving the flat container blank along an arcuate path of movement by the transport means from the first location to a second location, wherein the upper panel of the container blank is maintained in the substantially vertical orientation during the step of moving;

simultaneously contacting a lower edge of the flat container blank with unfolding means while the container blank is being moved to open the flat container blank until it acquires a substantially square cross-sectional shape;

flexing the container blank further by the unfolding means until the container blank acquires a substantially rhombic cross-sectional shape;

disengaging the container blank from the unfolding means to allow the container blank to resume its substantially square cross-sectional shape and detaching the open container blank from the transport means at the second location.

19. The method of claim 18 further comprising the steps of:

depositing the open container blank on conveyor means at the second location; and retaining the open container blank in its substantially square cross-sectional shape on the conveyor means.

* * * * *